US007426930B1

(12) United States Patent
Bailey et al.

(10) Patent No.: US 7,426,930 B1
(45) Date of Patent: Sep. 23, 2008

(54) DUAL COMPRESSION PAD FOR SURGICAL POSITIONER UNITS

(75) Inventors: James Bailey, Plainville, CT (US); Alan Wasley, Southington, CT (US); Martin Taylor, New Britain, CT (US)

(73) Assignee: IMP Inc., Plainville, CT (US)

( * ) Notice: Subject to any disclaimer, the term of this patent is extended or adjusted under 35 U.S.C. 154(b) by 216 days.

(21) Appl. No.: 11/438,115

(22) Filed: May 22, 2006

(51) Int. Cl.
*A61G 15/00* (2006.01)

(52) U.S. Cl. ..... 128/845; 128/112.1; 5/618; 5/624; 5/630; 5/648

(58) Field of Classification Search ..... 128/95.1, 128/845, 112.1, 96.1, 869, 875, 876; 5/630, 5/637, 618, 624, 640, 646; 134/6; 602/21; 607/86, 74, 68
See application file for complete search history.

(56) References Cited

U.S. PATENT DOCUMENTS 5,038,985 A * 8/1991 Chapin ..... 224/669
6,003,176 A * 12/1999 Wasley et al. ..... 5/624
6,553,573 B1 * 4/2003 Brown ..... 2/24
6,739,008 B1 * 5/2004 Kindrick ..... 5/655.9
6,941,951 B2 * 9/2005 Hubert et al. ..... 128/845

* cited by examiner

*Primary Examiner*—Patricia Bianco
*Assistant Examiner*—Ophelia Hawthorne

(57) ABSTRACT

A dual compression foam pad arrangement for use with surgical postioner devices is formed from a single pair of cloverleaf-shaped foam pieces. The foam piece in contact with the patient is more porous than the foam piece in contact with the positioner support plate for greater patient comfort. A solid plastic connector clip connects the pad arrangement with the surgical postioner support in press-fit relation.

7 Claims, 3 Drawing Sheets

DUAL COMPRESSION PAD FOR SURGICAL POSITIONER UNITS

BACKGROUND OF THE INVENTION

Surgical postioner devices such as described within U.S. Pat. No. 6,820,621 entitled "Lateral Surgical Positioner Device" and U.S. Pat. No. 6,003,176 entitled "Universal Lateral Positioner" require foam pads arranged on the metal support plates that come in contact with the patient during hip surgery to prevent dermal abrasion.

The foam pads usually consist of a plurality of pieces cemented together to form a square, round or rectangular structure defining a rectangular opening at one end to receive the metal support plate and a foam pad cemented to the opposite end for contact with the patient.

Since the pads are held together by cement, the cement could possibly become pliable under heat and pressure causing replacement during the surgery process.

Accordingly, one purpose of the invention is to disclose a method of providing a foam pad for use with hip procedure positioner devices, part of which is formed from a single pair of foam pieces, without requiring supplemental cement procedures.

Another purpose of the invention is to provide a dual compression arrangement whereby the pad in contact with the patient is more compressive than the pad in contact with the positioner to provide greater patient comfort during contact.

SUMMARY OF THE INVENTION

A dual compression foam pad arrangement for use with surgical postioner devices is formed from a single pair of foam pieces that are cloverleaf-shaped to provide more flexible contact with the patient. The foam piece in contact with the patient is made of a more porous polyurethane material than the foam piece in contact with the positioner support plate for greater patient comfort. A solid plastic connector clip is fixedly attached to the foam piece in contact with the surgical postioner support for press-fit connection therewith.

DESCRIPTION OF THE PREFERRED EMBODIMENT

Figure 1:
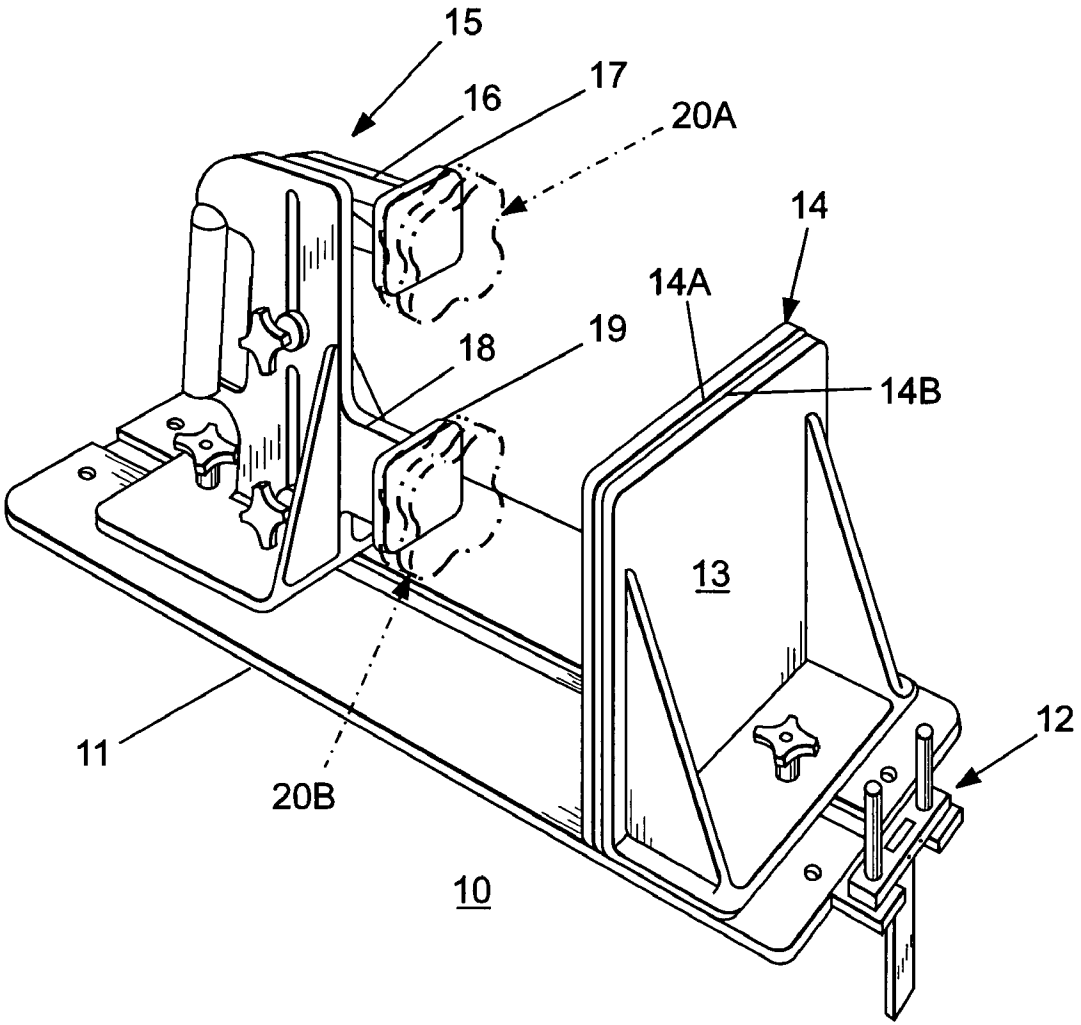
FIG. 1 is a top perspective view of a surgical positioner device which includes a pair of dual compression pads, depicted in phantom, in accordance with the invention.

The surgical postioner device described within U.S. Pat. No. 6,820,621 is depicted at 10 in FIG. 1 in the form of a metal support plate 11 arranged for connection with a hospital bed support rail (not shown) via the side rail connector 12.

The patient rear support 13 is supported on the plate 11 and retains a rear pad 14 consisting of a first layer 14A of more porous polyurethane material than the second layer 14B for purposes which will be described below in greater detail.

As described within aforementioned U.S. Pat. No. 6,820,621, a front support 15 is supported on the plate 11 and retains a top arm 16 terminating in a top support plate 17 and a bottom arm 18 terminating in a bottom support plate 19. The top and bottom dual compression pads, hereafter "pads", 20A, 20B, shown in phantom are attached to the top and bottom plates 17, 19 in the manner to be described below.

Figure 2:
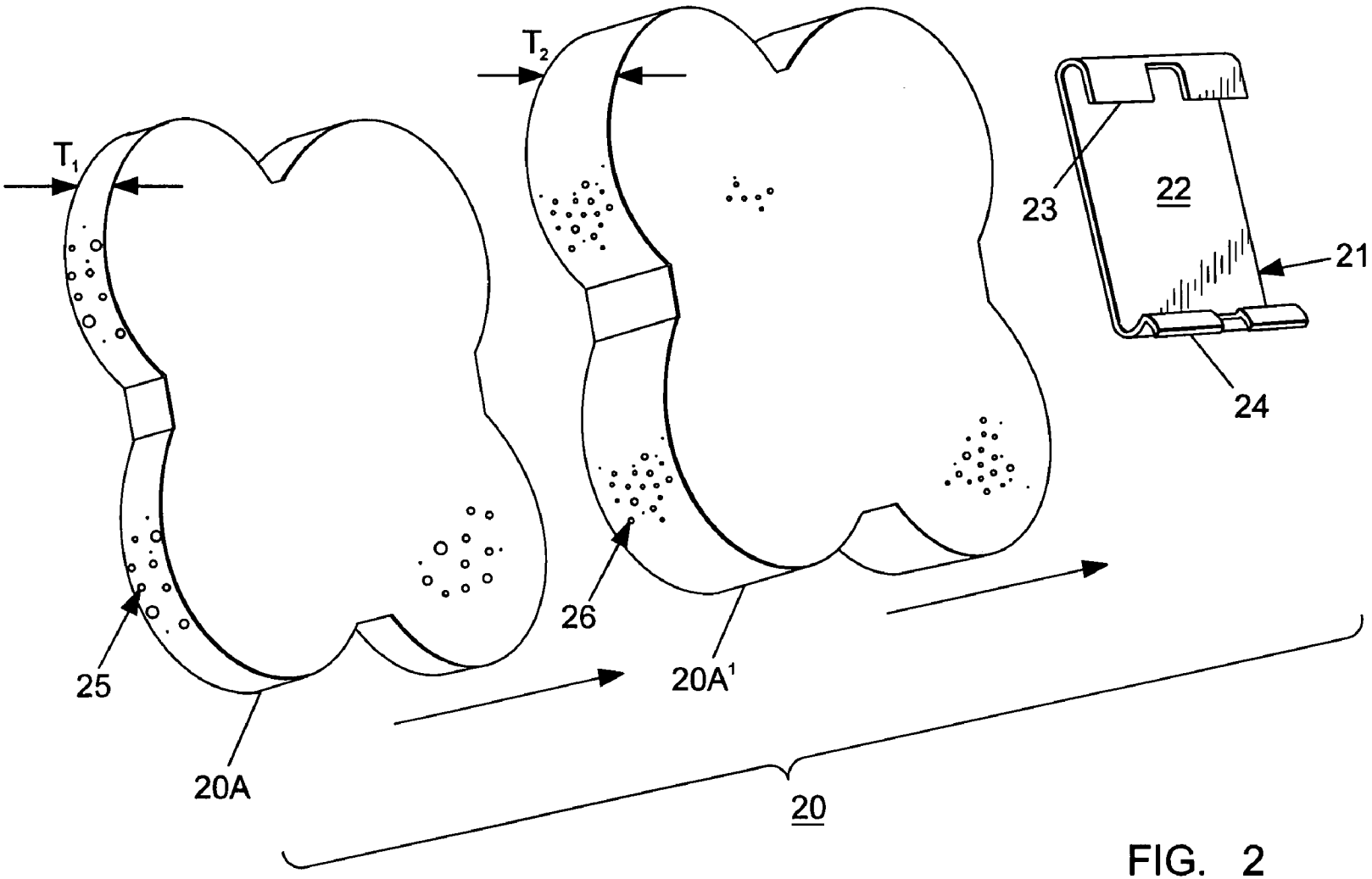
FIG. 2 is a front perspective view of one of the dual compression pads of FIG. 1 in isometric projection prior to assembly.
Figure 3:
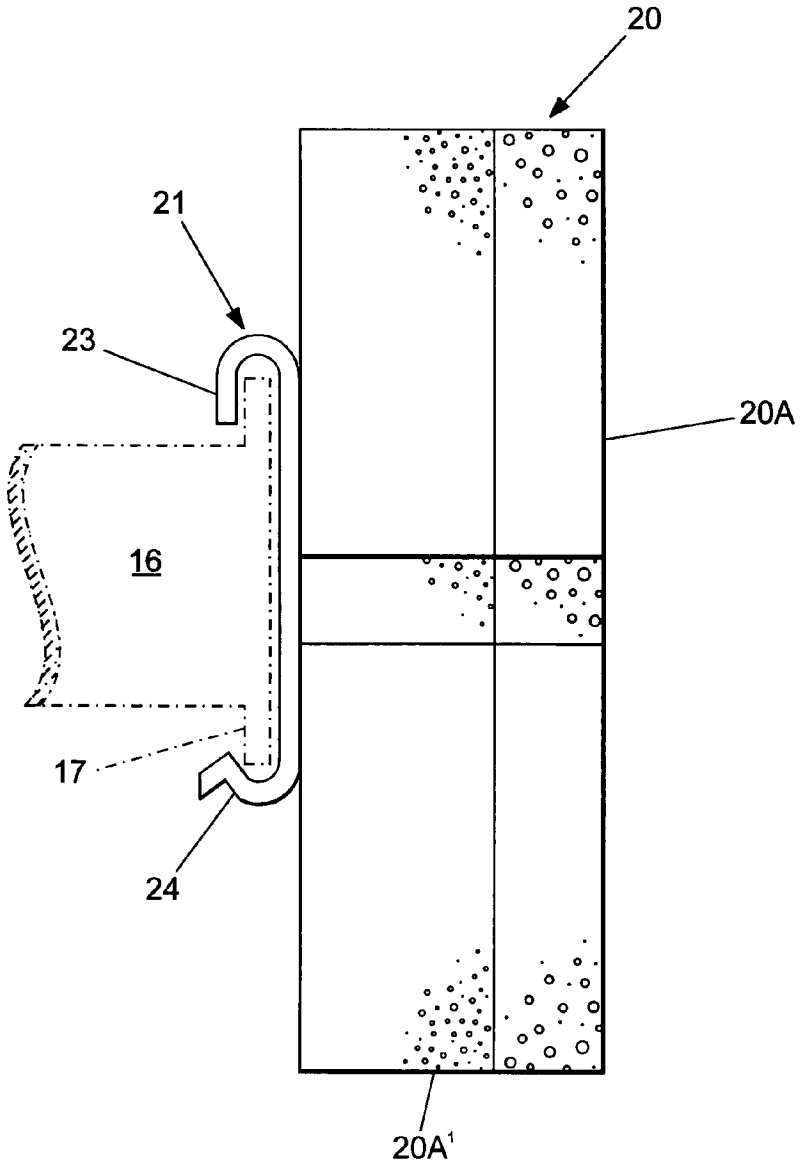
FIG. 3 is an enlarged side view of one of the dual compression pads of FIG. 1 attached to one of the support plates of the surgical positioner device therein.

The arrangement of the pads 20A and 20B relative to the connector clip or plate 21 is best seen by now referring to FIG. 2. Although only the upper pad 20A is depicted, the lower pad 20B of FIG. 1 is assembled in a similar manner. The pad 20A which comes in contact with the patient (not shown) is formed of a less dense, more porous polyurethane plastic material than the pad 20A' which comes in contact with the surgical postioner plate 17 of FIG. 1 as indicated by the spacing of the openings 25 within the thickness t1 thereof.

The pad 20A' which comes in contact with the surgical postioner plate 17 of FIG. 1 is formed of a more dense, less porous polyurethane plastic material than the pad 20A which comes in contact with the patient as indicated by the spacing of the openings 26 within the thickness t2 thereof.

After pad 20A is moved in the indicated direction and is attached to pad 20B, by cementing or by means of a laser weld process, both pads 20A, 20B are moved into contact with the connector plate or clip 21 made of a solid plastic material, and are attached to the plate or clip by cementing or by means of a similar laser weld process. To facilitate attachment of the plate or clip 21 to the postioner plate 17 of FIG. 1 the rectangular plastic piece 22 comprising the body of the plate or clip 21 terminates at a top U-shaped slot 23 and at a bottom U-shaped slot 24, as indicated.

The attachment of the top pad 20, consisting of pads 20A, 20A' joined together and to the plate or clip 21, to the top plate 17 at the end of the top arm 16 of surgical postioner 10 of FIG. 1, shown in phantom, is accomplished by pressing the plate or clip 21 against the top plate 17 and capturing the top plate via the top and bottom U-shaped slots 23, 24 as indicated. To prevent the clip from moving in the horizontal plane, a pair of top and bottom apertures 22A, 22 B formed in the U-shaped slots thereby capture the top parts of top and bottom arms 16, 18 (FIG. 1) during the attachment.

The bottom pad 20B is attached to the bottom plate 19 at the end of the bottom arm 18 of the surgical postioner 10 of FIG. 1 in a similar manner.

When the surgery is completed, the top and bottom pads 20A, 20B of FIG. 1 are removed from the top and bottom plates 17, 19 by simply prying the respective U-shaped slots off the respective ends of the top and bottom plates. The rear pad 14 of FIG. 1 containing outer pad 14A for contact with the patient is also formed of a less dense, more porous polyurethane plastic material than the inner pad 14B which comes in contact with the surgical postioner plate 13 for greater patient comfort and convenience.

An arrangement has herein been described for fabricating a pair of clover-shaped patient support plates that are removable attached to surgical positioner units via plates or clips. The provision of less dense porous plastic material for ease and comfort to the patient is an important feature of the instant invention.

The invention claimed is:

1. A surgical support device comprising:

a support plate arranged for attaching to a hospital bed side rail, a front support upstanding from said support plate and a rear support upstanding from said support plate;

a top and bottom arm extending from said front support, said top and bottom arms terminating in top and bottom patient support plates;

a top patient support pad removably attached to said top plate in press-fit relation, said top patient support pad includes a top plastic clip on one side thereon for providing said press-fit attachment to said top plate and said bottom patient support pad includes a bottom plastic clip on one side thereon for providing said press-fit attachment to said bottom plate; and a bottom patient support pad attached to said bottom plate in press-fit relation;

said top patient support pad includes a top plastic clip on one side thereon for providing said press-fit attachment to.

2. The surgical support device of claim 1 wherein top patient support pad comprises a compression foam material having a first layer arranged for receiving a patient's limb and a second layer proximate said top surgical support plate.

3. The surgical support device of claim 2 wherein said first layer comprises polyurethane foam having a first density for reducing traction between said patient's limb and said surgical support plate.

4. The surgical support device of claim 2 wherein said second layer comprises polyurethane foam having a second density greater than said first density for reducing traction between said first layer and said surgical support plate.

5. The surgical support device of claim 2 wherein said first and second layers define a cloverleaf configuration.

6. The surgical support device of claim 1 wherein said bottom patient support pad comprises a compression foam material having a first layer arranged for receiving a patient's limb and a second layer proximate said bottom surgical support plate.

7. The surgical support device of claim 1 including a rear patient support pad attached to said rear support wherein said rear support pad includes a rear first layer comprising polyurethane foam having a first density for reducing traction between said patient's back and said surgical support plate and a second layer comprises polyurethane foam having a second density greater than said first density for reducing traction between said second layer and said rear surgical support plate.

* * * * *